US006725545B2

(12) United States Patent
Frank

(10) Patent No.: US 6,725,545 B2
(45) Date of Patent: Apr. 27, 2004

(54) KINETIC OPENING FOLDING KNIFE

(75) Inventor: Bram M. Frank, Clearwater, FL (US)

(73) Assignee: Spyderco, Inc., Golden, CO (US)

( * ) Notice: Subject to any disclaimer, the term of this patent is extended or adjusted under 35 U.S.C. 154(b) by 0 days.

(21) Appl. No.: 09/945,264

(22) Filed: Aug. 31, 2001

(65) Prior Publication Data

US 2003/0041460 A1 Mar. 6, 2003

(51) Int. Cl.[7] ..... B26B 1/02; B26B 3/06

(52) U.S. Cl. ..... 30/155; 30/123; 30/151; 30/298.4; 30/342; 30/337; 30/161; 7/158

(58) Field of Search ..... 30/151, 153, 155, 30/158, 289, 340, 298.4, 296.1, 160, 161, 337, 342; D22/118; 7/168, 119, 167, 158

(56) References Cited

U.S. PATENT DOCUMENTS 552,077 A * 12/1895 Wagner ..... 30/528
4,776,094 A 10/1988 Glesser ..... 30/160
D333,859 S * 3/1993 Meyer ..... D22/118
5,704,129 A * 1/1998 Glesser ..... 30/155
5,799,400 A * 9/1998 Glesser ..... 30/155
5,878,500 A * 3/1999 Emerson ..... 30/158
5,887,347 A * 3/1999 Gibbs ..... 30/161
D425,391 S 5/2000 Bradichansky ..... D8/99
D441,827 S * 5/2001 Frank ..... D22/118

OTHER PUBLICATIONS

1998 Spyderco Catalog, pp. 54 and 65.

* cited by examiner

*Primary Examiner*—Boyer D. Ashley
(74) *Attorney, Agent, or Firm*—Sheridan Ross, P.C.

(57) ABSTRACT

A multi-purpose self defense tool is provided which can be used for pinching an opponent, delivering a blow and/or as a kinetic opening folding knife by positioning a pointed hump located on the non-cutting edge of the blade against an object or the body of an opponent and dragging the tool in a rapid motion.

23 Claims, 13 Drawing Sheets

KINETIC OPENING FOLDING KNIFE

FIELD OF THE INVENTION

The present invention relates to hand held self defense apparatus, and more specifically folding knives which can be used as a self defense mechanism for pinching or striking a blow as well as a cutting instrument.

BACKGROUND OF THE INVENTION

Self defense mechanisms and more specifically handheld folding knives have been used for decades as self protection devices and for a multitude of other purposes. These devices are commonly used by police, prison guards and the military for self protection and to thwart an attack by an assailant. Additionally, these devices are useful to assist car accident victims who are trapped in seat belts, and in a variety of other applications where a sharp blade is useful in combination with a hand-held tool capable of shattering glass.

Other types of tools have previously been made to serve similar purposes. For example, brass knuckles were invented to deliver a striking blow to a body part. Handheld glass breaking tools have been used to assist firemen and policemen to break windows and assist car accident victims trapped in vehicles. Finally, there are an endless number of batons and self restraint devices such as handcuffs which may be used by the police to restrain or temporarily disable a prisoner or assailant.

Unfortunately, carrying all of these numerous types of knives, batons, self restraint devices and tools is extremely cumbersome and not practical. Furthermore, in a combat situation it is not feasible to attempt to locate or use a variety of different tools at the same time.

Thus, it would be extremely beneficial to have a combined handheld tool knife which could be used by the police, military personnel and citizens alike which could perform a multitude of functions as a self defense and emergency tool. These functions would include a pointed metallic "hump" on the blade which could be used for delivering a blow or to provide a pinch point. Additionally, other portions of the tool handle and blade would be designed to provide a pinch point, deliver a blow or to shatter glass. Finally, the apparatus would have a blade which could be opened quickly with one hand by drawing a portion of the knife blade across an object or a portion of an assailant's body.

SUMMARY OF THE INVENTION

It is thus an object of the present invention to provide a self defense tool which performs a multitude of functions in one handheld device. Thus, the tool can be used to deliver a striking blow, break glass, provide pinch points for disabling an opponent and provide a sharp cutting instrument if necessary.

It is a further object of the present invention to provide a knife blade opening device which can be selectively opened by dragging a pointed hump portion of the blade across an opponents body or other object to facilitate opening. Thus, the knife blade can be opened without requiring the use of a second hand, finger or thumb.

Additionally, it is an object of the invention to provide a self defense tool which can be used to perform a multitude of different functions without significantly changing the hand position on the tool. Thus, by slightly rotating or repositioning the tool in the user's hand the tool may be used for a variety of different self defense purposes such as pinching, striking a blow or using a sharpened blade in a cutting motion. These changes in position can be achieved quickly and efficiently with one hand while allowing the other had to be free for other purposes. Thus, in one aspect of the present invention a folding knife self defense tool is provided which comprises:

- a folding knife with a kinetic opening knife blade which is adapted for positionally opening on an object or the body of an opponent, comprising:
- a handle having a front end, a rear end and a cavity positioned therebetween;
- a knife blade rotatably interconnected to said front end of said handle, said knife blade having a front end, a heel end, a cutting edge and an upper edge, said upper edge having a substantially pointed thumb extension extending therefrom, wherein when a lateral force is applied to said pointed thumb extension in a direction parallel to said longitudinal axis of said knife blade and in a direction opposite said rear end of said knife handle, said knife blade opens to a first extended position of use, wherein said knife blade is substantially an extension of said knife handle; and
- a blade locking mechanism interconnected to said knife handle and in operable engagement with said heel end of said knife blade, wherein said blade can be reversibly locked in said first extended position of use.

It is a further aspect of the present invention to provide a training knife which includes all of the functional attributes described above, but is safe to use for training and educational purposes. Thus, in one aspect of the present invention a knife blade is provided which does not have any type of sharpened cutting edge, and thus is substantially incapable of cutting or injuring a user or participant in a training exercise.

DETAILED DESCRIPTION

Figure 1:
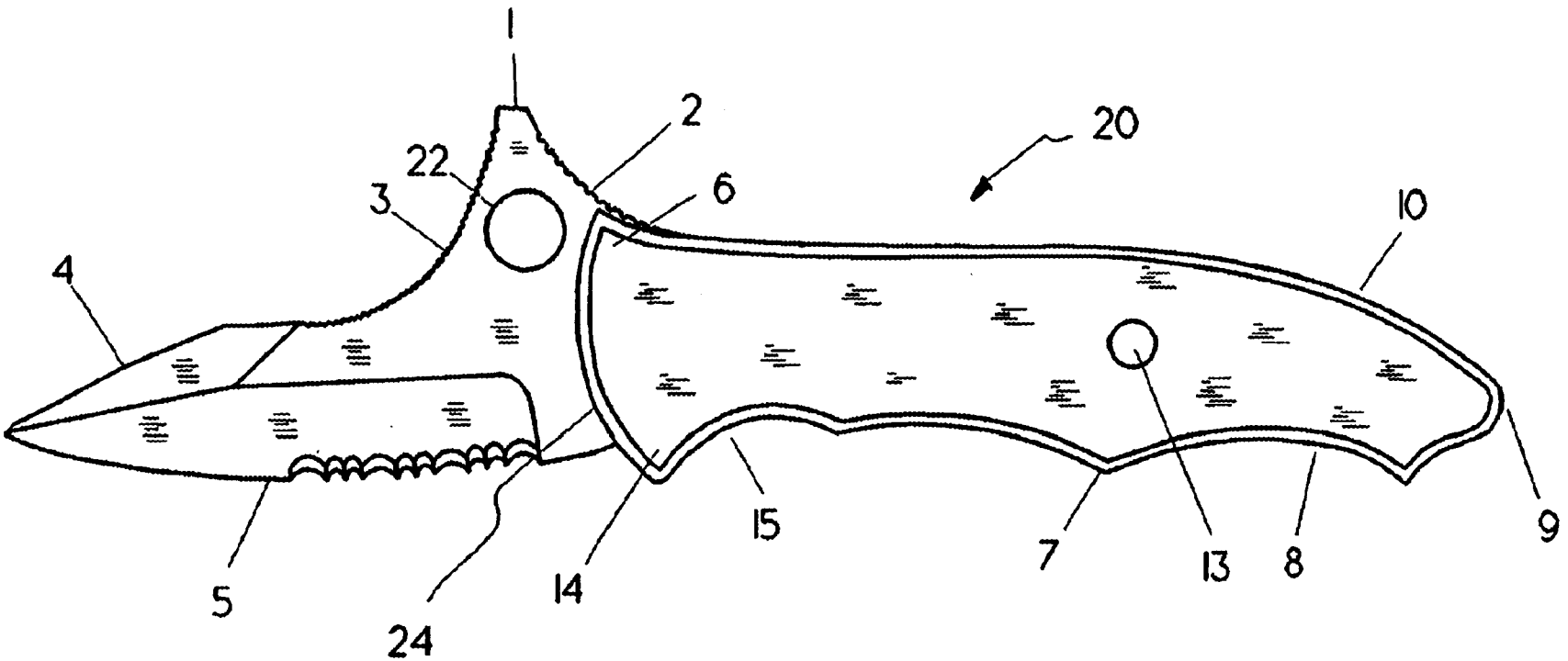
FIG. 1 is a front elevation view of a folding knife with the blade shown in a first extended position of use.

Referring now to the drawings, FIG. 1 represents a folding knife 20 with the blade 5 in a first extended position of use and positioned substantially co-extensive with the longitudinal axis of the knife handle. The knife blade 5 is rotatably interconnected to a forward end of the knife handle by means of a pivot pin (not shown). The knife blade has a primary cutting edge 5, a blade secondary edge 4, an extended thumb ramp 1 which defines a posterior curve of the thumb ramp 2 and an interior curve of the thumb ramp 3. In a preferred embodiment of the present invention, the knife blade primary cutting edge 5 may additionally include a serrated edge which improves the ability of the knife blade to cut rope, twine and other materials. Additionally, to facilitate the opening of the knife blade with a user's finger, a finger opening aperture 22 may be provided in the extended thumb ramp 1. As seen in FIG. 1, the posterior curve of the thumb ramp 2 may include a frictional surface to engage a user's thumb and prevent the thumb from overextending past the extended thumb ramp 1. Additionally, the interior curve of the thumb ramp 3 may include a frictional surface to facilitate the opening of the blade on an object or an opponents forearm as shown in FIGS. 3–7.

Further, the thumb ramp posterior curve 2 may include a frictional surface which in a reverse grip cradles the user's hand and substantially prevents the user's hand from sliding onto the blade. In addition, the poster curve thumb ramp 2 locks the knife into the user's hand in a reverse grip, thus keeping the blade safely away from the user's wrist. Additionally, the posterior curve of thumb ramp 2 may include a frictional surface which is used for come-alongs, hand locks and wrist control techniques.

Additionally the interior curve of the thumb ramp 3 may include a frictional surface for use in restraint holds on fingers and digits and limbs. Further, the interior curve of the thumb ramp may include a frictional surface for use in take down and control techniques. Finally, the interior curve of the thumb ramp 3 may include a frictional surface designed to activate a pressure point control on an opponent.

Figure 2:
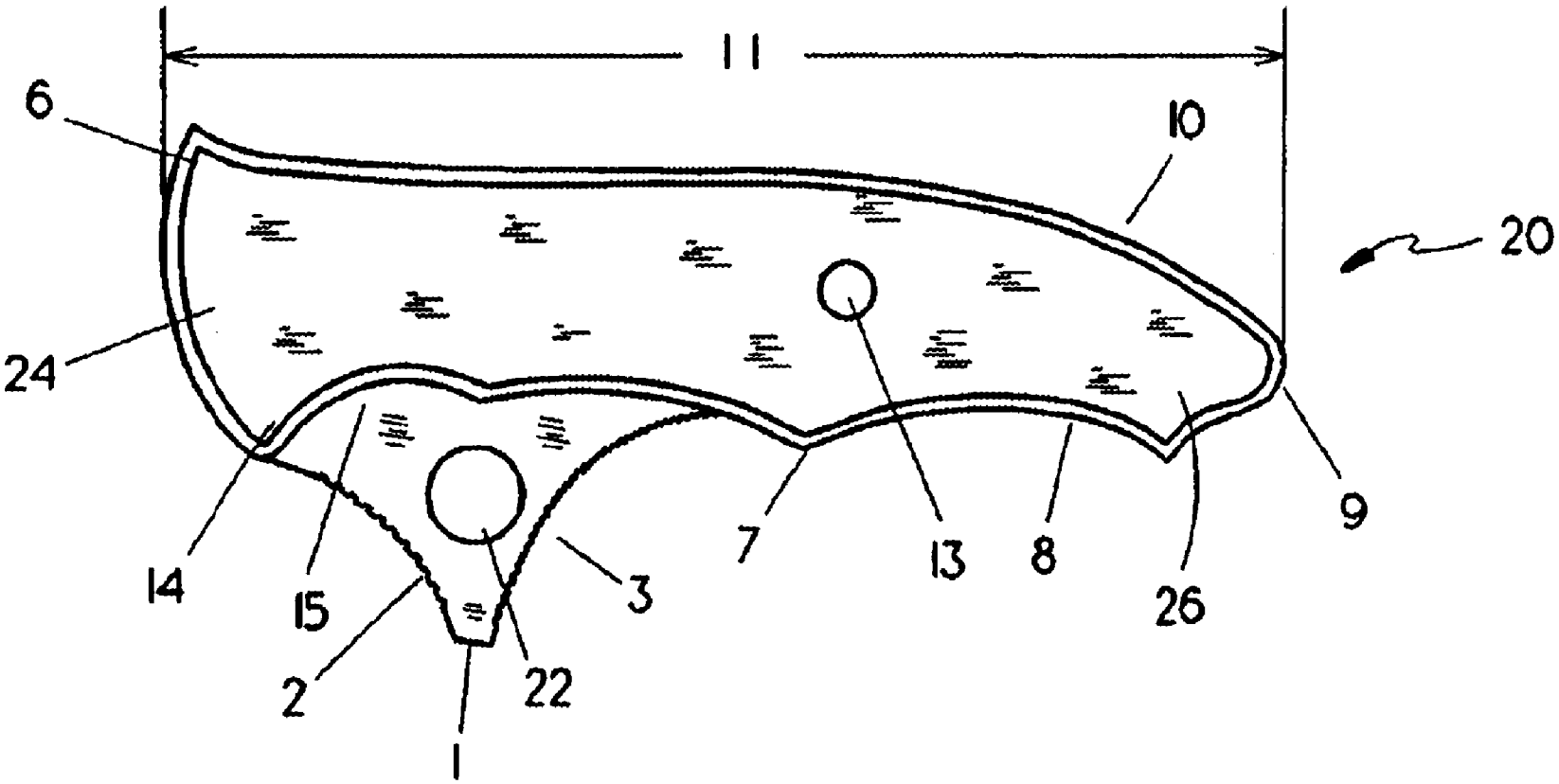
FIG. 2 is a front elevation view of the folding knife shown in FIG. 1 with the blade shown in a closed position.

Referring now to FIG. 2, the folding knife 20 is shown with the knife blade in a closed position within the knife handle. The knife handle is generally comprised of a handle forward end 24, a handle rear end 26 and a handle cavity 28 extending therebetween which is operatively sized to receive at least the blade primary cutting edge 5. The forward end of the knife handle may comprise handle horns 6 on upper edge and a handle interior lower guard 14 on the forward end. The handle horns are used to pinch an opponent's body parts such as the ears or skin by placing that body part between a thumb or other finger in the handle horn. The end of the thumb ramp 1 can also be used as a pincher by placing the end of the thumb ramp against the body part on one side and a thumb or other finger on the other side of the body part. The handle horns are additionally used to insert into an opponents joints to maneuver the joint into a locking position.

The handle interior lower guard 14 in an open blade position may also be used as a forward hammer grip or reverse hammer grip and to protect the first finger from sliding up onto the blade. The lower guard is additionally used to protect the fingers of the user from an opponent reaching ones fingers or another knife blade coming in contact with the user's fingers. Positioned adjacent the handle interior lower guard 14 is the finger support notch 15. The finger support notch 15 is generally arcuately shaped and is used to give support for the first finger of a user's finger in a forward hammer grip that may additionally be used for a pinky finger support in a reverse icepick grip to facilitate grasping the handle in a firm manner.

The handle rear end 26 additionally includes a handle butt end 9 which preferably has a carbide tip insert. It should be understood that any material can be used for the knife handle which will provide support for use of the knife blade; however, to improve the users ability to grip, it is preferred that the handle be substantially rigid. In addition, the handle can be coated or padded in such a way so as to improve the comfort of holding and using the knife. The handle butt end 9 is used to strike objects or opponents in a hammer type fashion and may be used to break glass in emergencies and/or to strike an opponent with either the blade in an open or closed position. Positioned proximate to the handle rear end is a handle finger retention point 8 positioned near the lower end of the handle and which is used to stop a users hand from slipping while holding the knife and may additionally be used to strike an opponent with the tip defined near the handle rear end 26.

The handle may additionally include a handle dimple 13 which is positioned exactly opposite a spoon in a knife clip 12 so that the knife spins evenly in the hands and may be used to identify the knife position in a users hand. Additionally, the knife clip 12 may be positioned on one side of the knife handle to facilitate interconnecting the folding knife 20 to an object such as a users trousers or other object. This embodiment may be seen in FIG. 8. The knife clip 12 preferably has a spoon 30 which is generally positioned immediately opposite the handle dimple 13 and which allows the user of the knife handle to have greater control and positioning of the folding knife 20. Further, the spoon clip with indentation allows for the fingers by inertia to flow into the deep part as the thumb sets into the index dimple 13 and then the inertia of a turning motion enables the knife to change positions from a forward grip to a reverse grip to forward grip, rotating on an axis around the dimple 13 and spoon 30. In an alternative embodiment of the present invention, the handle dimple 13 may be slightly offset and not positioned directly opposite from the spoon 30 of the knife clip 12.

Figure 3:
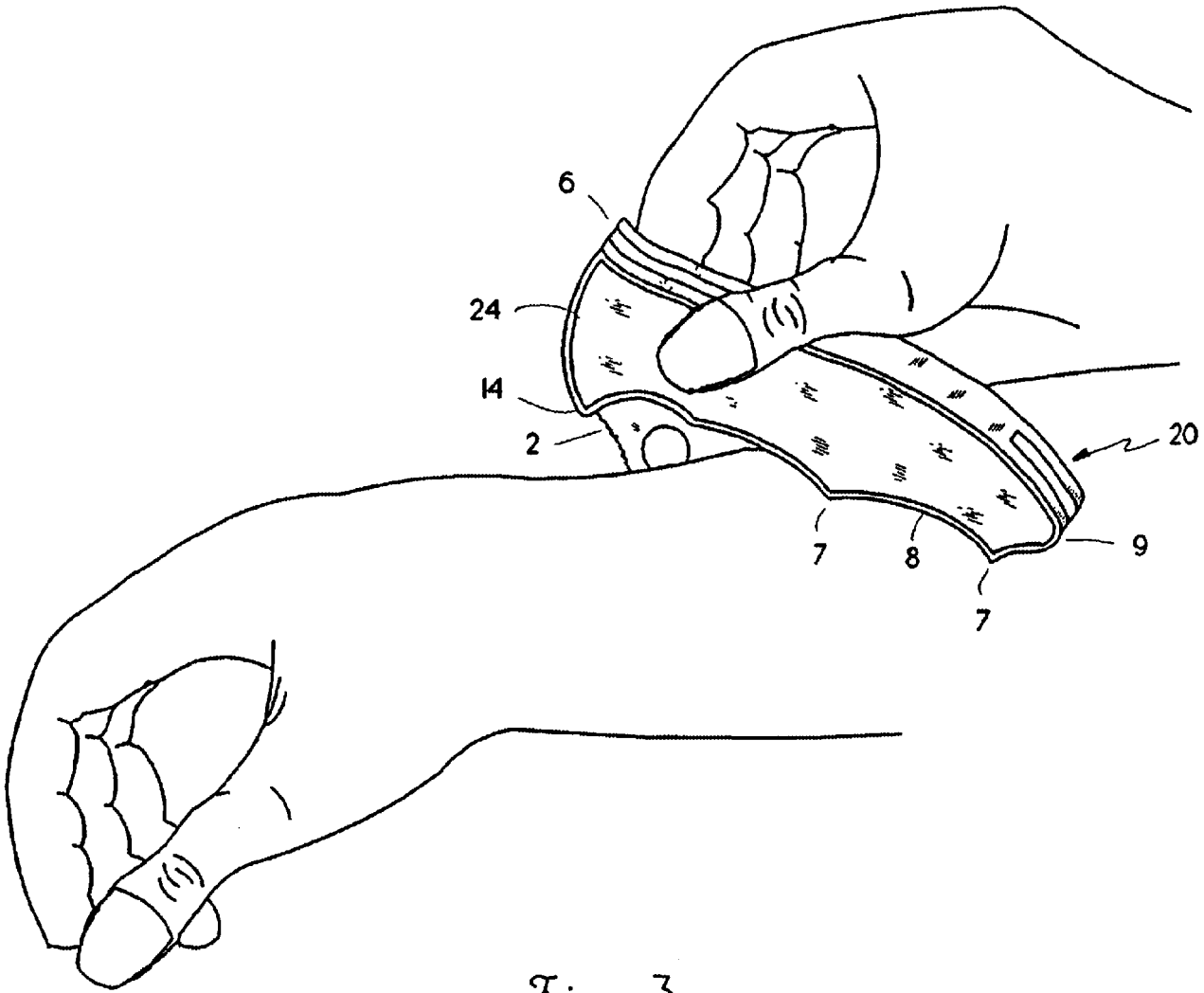
FIG. 3 is a front perspective view of the knife stand in FIG. 1 with the knife blade shown in a closed position and the thumb extension ramp engaged against an opponent's wrist to initiate opening of the knife blade.
Figure 4:
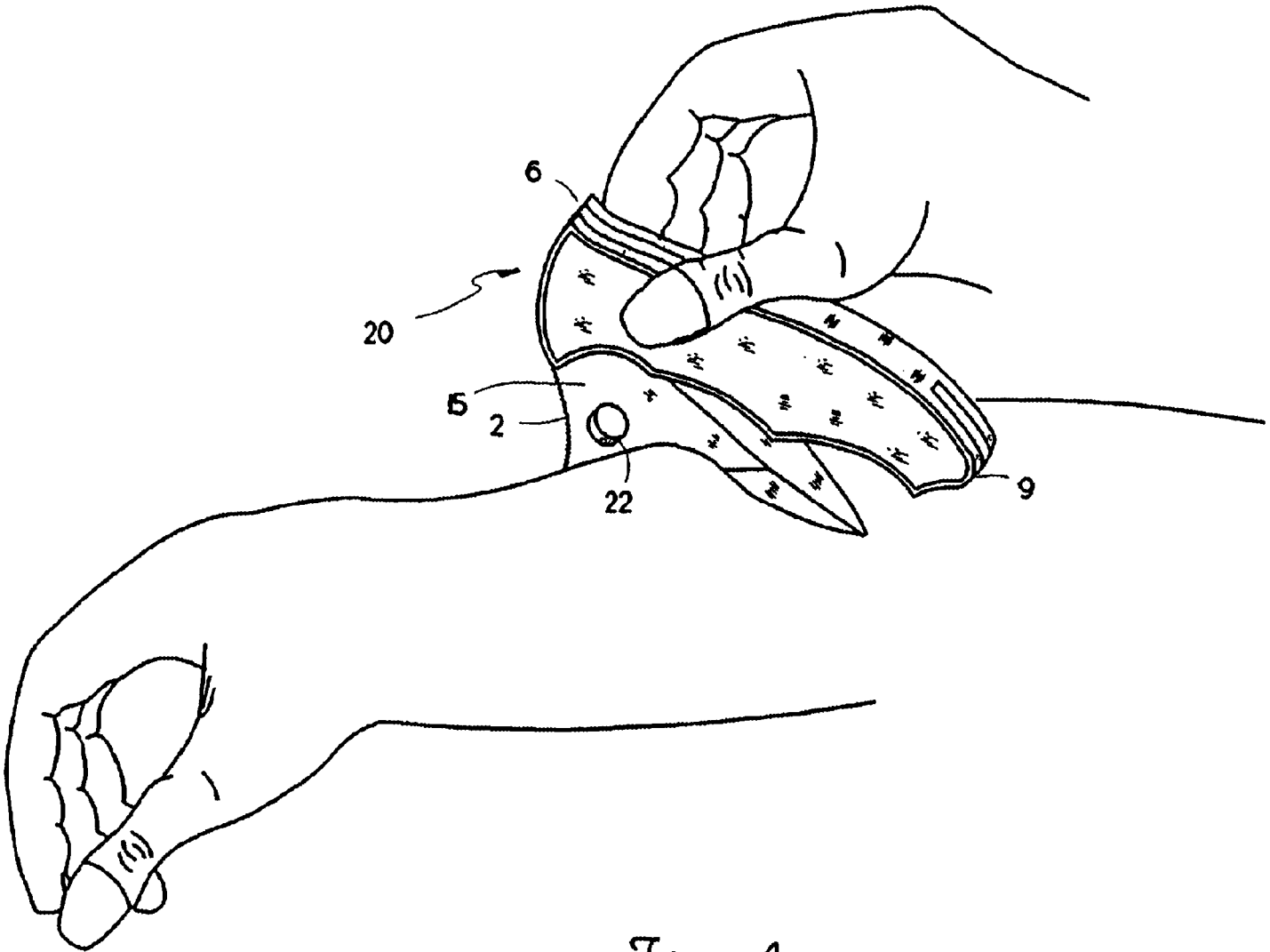
FIG. 4 is a front perspective view of the knife shown in FIG. 3 with the knife blade beginning to open.
Figure 5:
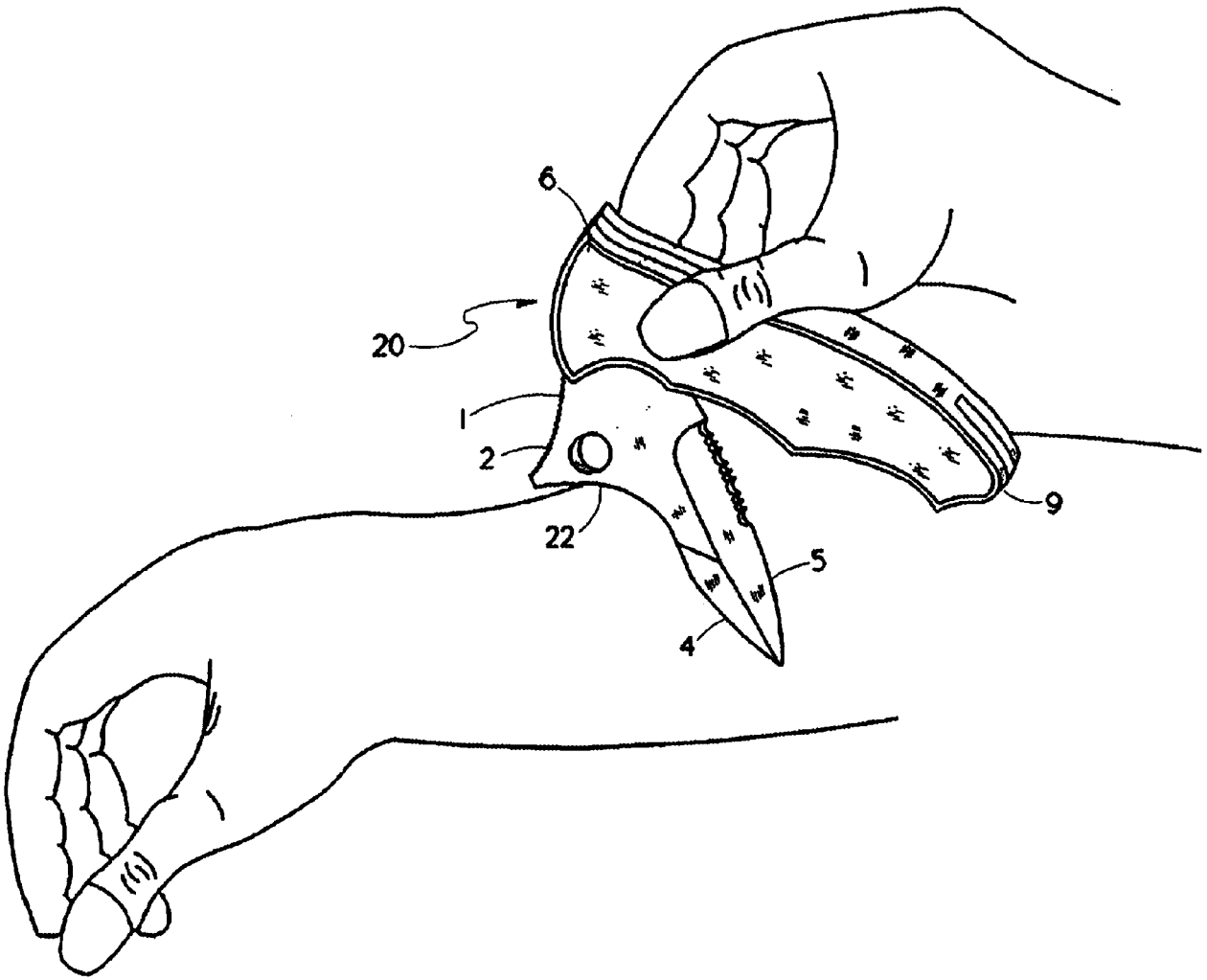
FIG. 5 is a front perspective view of the knife shown in FIG. 3 with the knife blade further opened.
Figure 6:
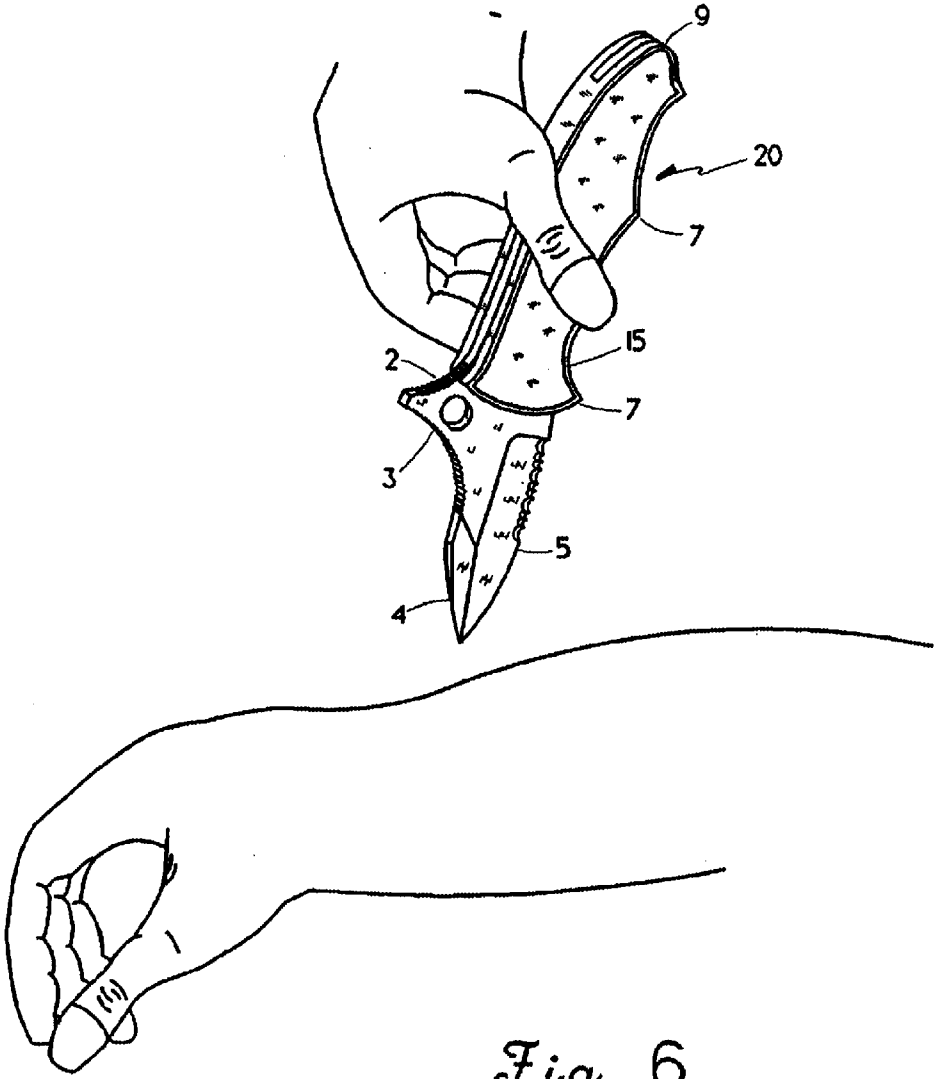
FIG. 6 is a front perspective view of the knife shown in FIG. 3 with the knife blade in a fully extended position of use and held in a user's hand.
Figure 7:
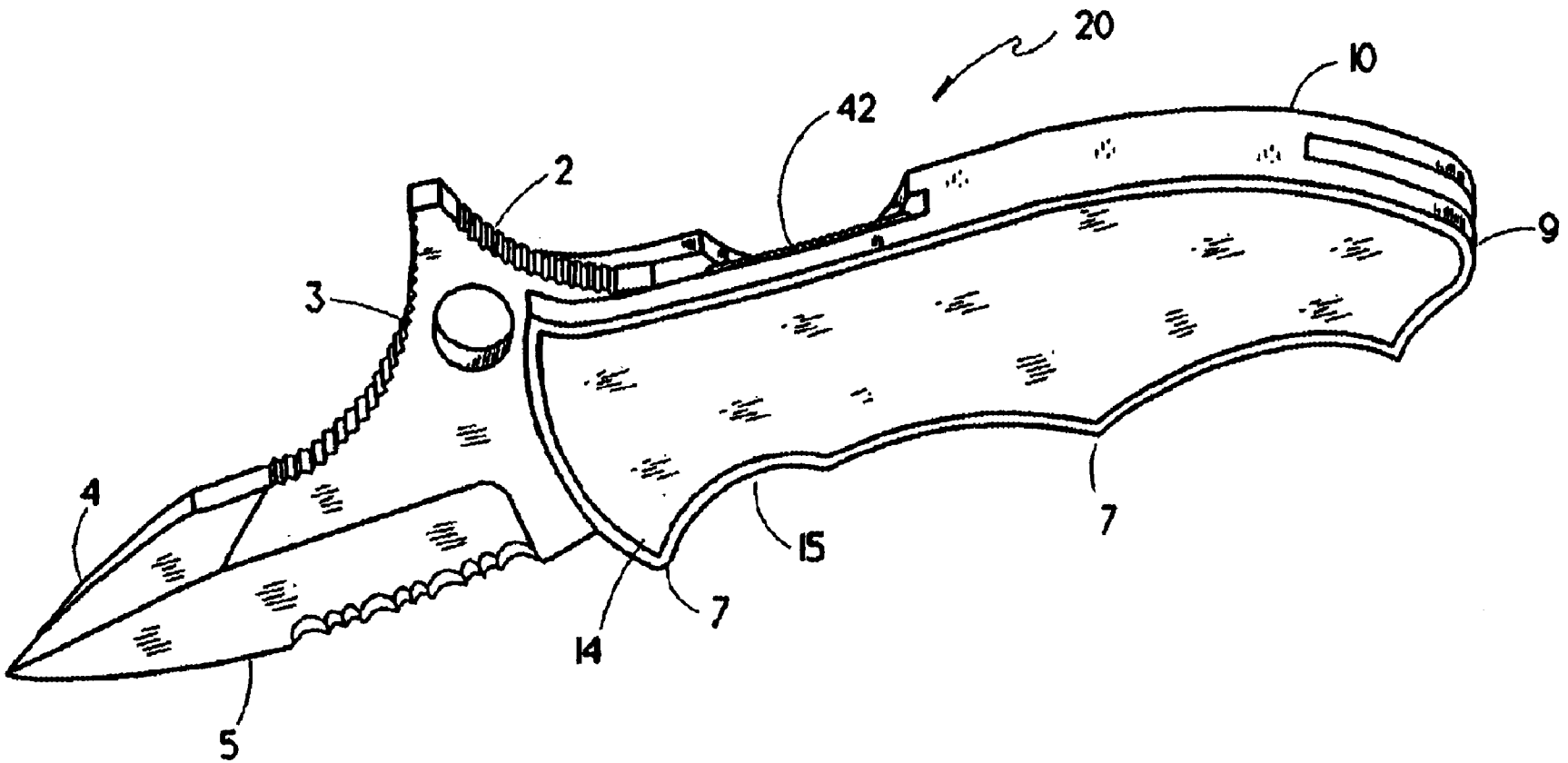
FIG. 7 is a front perspective view of the knife shown in FIG. 1 with the knife blade shown in an extended position.

Referring now to FIGS. 3–7, the folding knife 20 of the present invention is shown dynamically moving from a closed position in FIG. 3 to an open position of use in FIG. 7. More specifically, FIG. 3 depicts the folding knife 20 in a completely closed position with the interior curve of the thumb ramp 3 positioned against a forearm of either the user or an opponent. Referring now to FIG. 4, the user of the folding knife 20 is pulling the folding knife 20 in a direction toward the handle rear end 26, thus engaging the interior curve of the thumb ramp 3 against an opponents forearm or other object. As shown in FIG. 5, as the knife handle continues to be drawn away from the forearm, the interior curve of the thumb ramp 3 continues to engage the forearm, thus opening the knife blade from a closed position of use to an extended position of use. This dynamic motion results in the inevitable opening of the blade as shown in FIG. 6 and FIG. 7. The advantage of this particular type of opening mechanism is that the knife may be opened without the user putting any finger pressure whatsoever on the knife blade, and completely opening the knife by means of engaging an interior curve of the thumb ramp 3 on an object as an opponents arm, or other object. Thus, no spring mechanisms or other type of inherently dangerous opening devices are necessary to open the knife blade.

Figure 8:
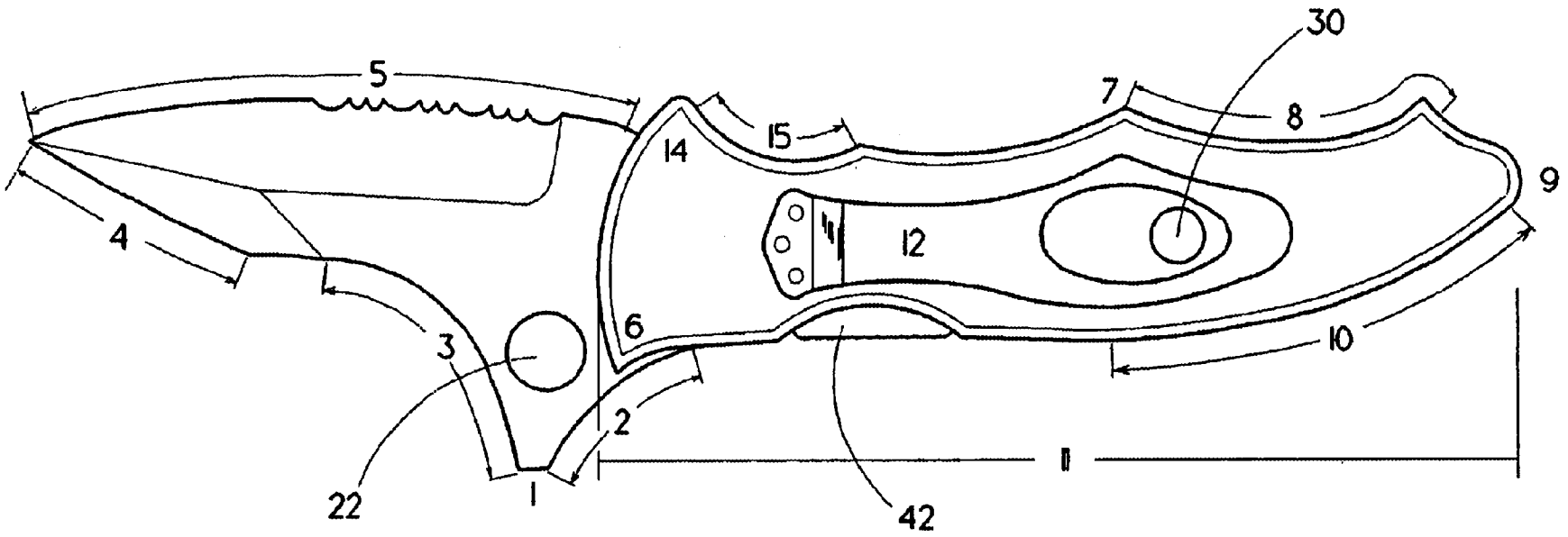
FIG. 8 is a rear elevation view of the knife shown in FIG. 1.

Referring now to FIG. 8, the folding knife 20 of the present invention is shown from the rear with the blade in a completely extended position wherein the knife blade is substantially co-extensive with the knife handle. FIG. 8 depicts the rear view of the knife and shows the clip 12 which can be used to attach the knife to a piece of clothing such as a pant pocket or belt for ease of transporting and securing the knife. FIG. 8 also shows the spoon 30 in the clip 12. The spoon 30 is positioned on the clip such that the knife spins evenly in the hands and may be used to identify the knife position in a users hand. Preferably the spoon 30 which is positioned immediately opposite the handle dimple 13 and which allows the user of the knife handle to have greater control and positioning of the folding knife 20. Alternatively, the spoon 30 may be positioned anywhere along the knife clip.

Figure 9:
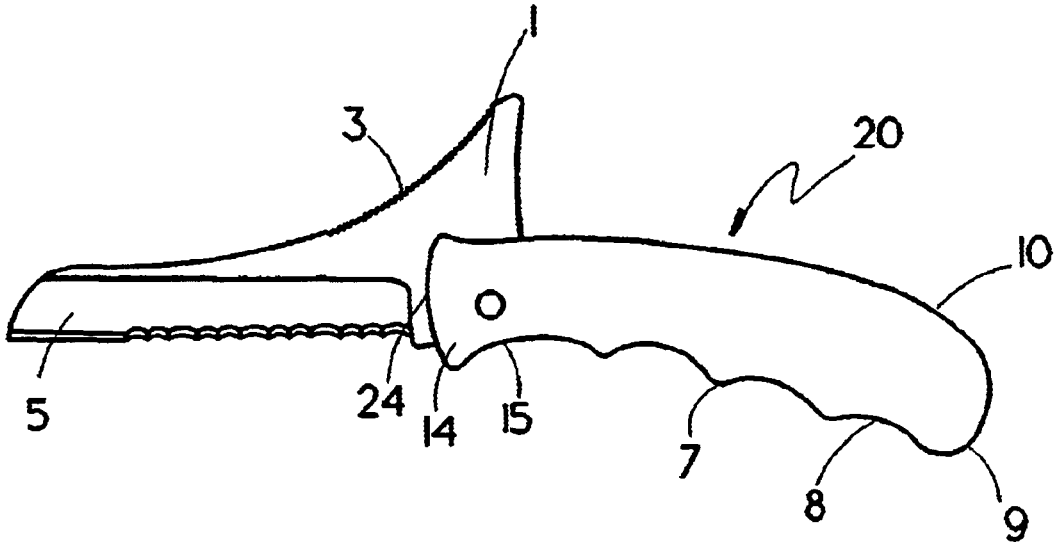
FIG. 9 depicts an alternate embodiment of the present invention, with only an anterior curve of the thumb extension ramp, and the knife blade in a complete extended position.
Figure 10:
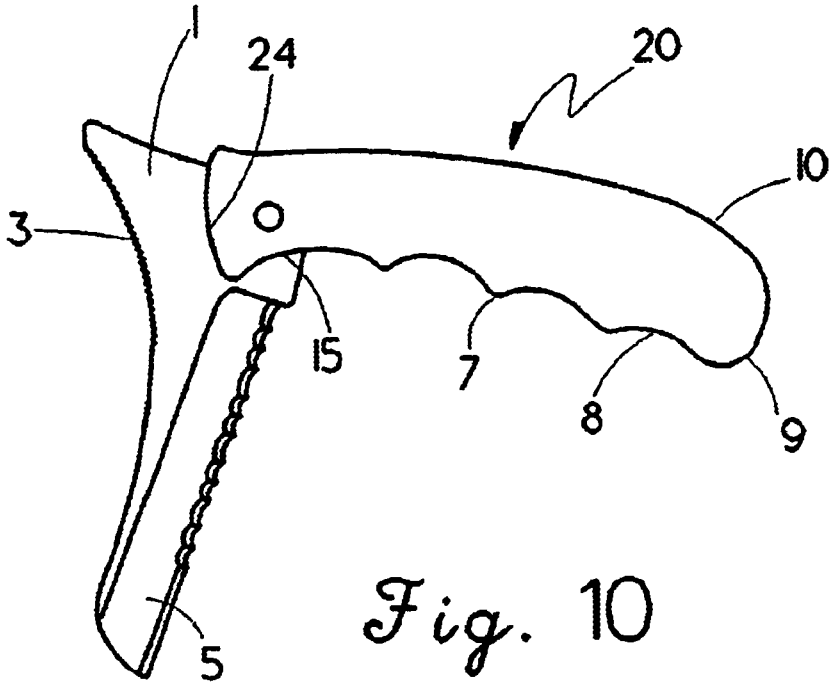
FIG. 10 is a front view of the knife shown in FIG. 9, with the knife blade partially extended.

FIG. 9 depicts an alternate embodiment of the knife shown in FIG. 1. The knife shown in FIG. 9 has all of the components and operates in the same way as described for the embodiment of the knife described in FIGS. 1 through 8. However, the thumb ramp 1 of the embodiment depicted in FIG. 9 does not possess the finger opening aperture 22 or the posterior curve of the thumb ramp 2. FIG. 10 depicts a knife with this alternate embodiment partially open. The alternate embodiment shown in FIGS. 9 and 10 can still be opened by engaging the anterior curve of the thumb ramp 3 against an appendage of an attacker, or other object. The force of dragging the anterior curve of the thumb ramp 3 against the object will kinetically open the knife blade.

Figure 11:
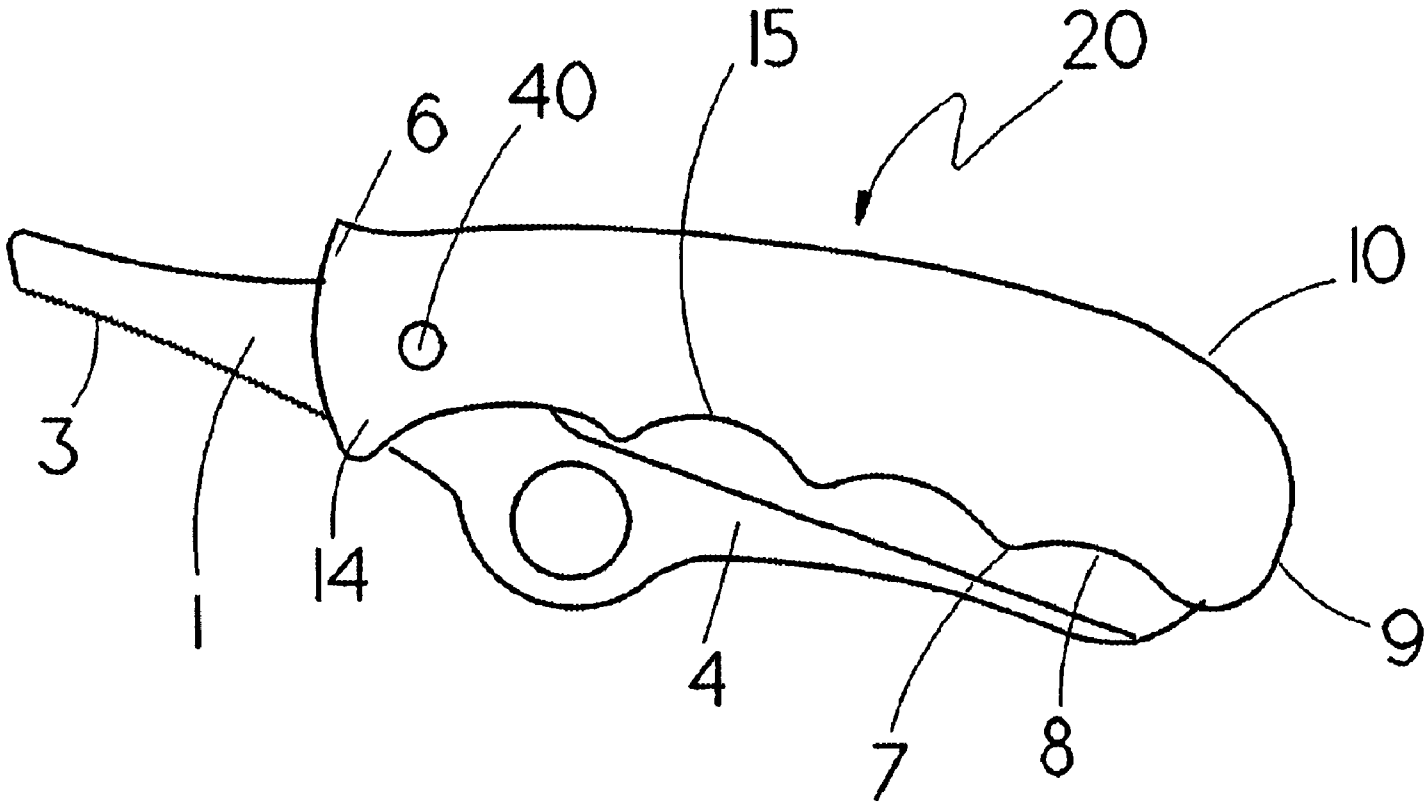
FIG. 11 is a further embodiment of the present invention, with the knife blade in a closed position, and the extension ramp extending from a posterior end of the knife blade.
Figure 12:
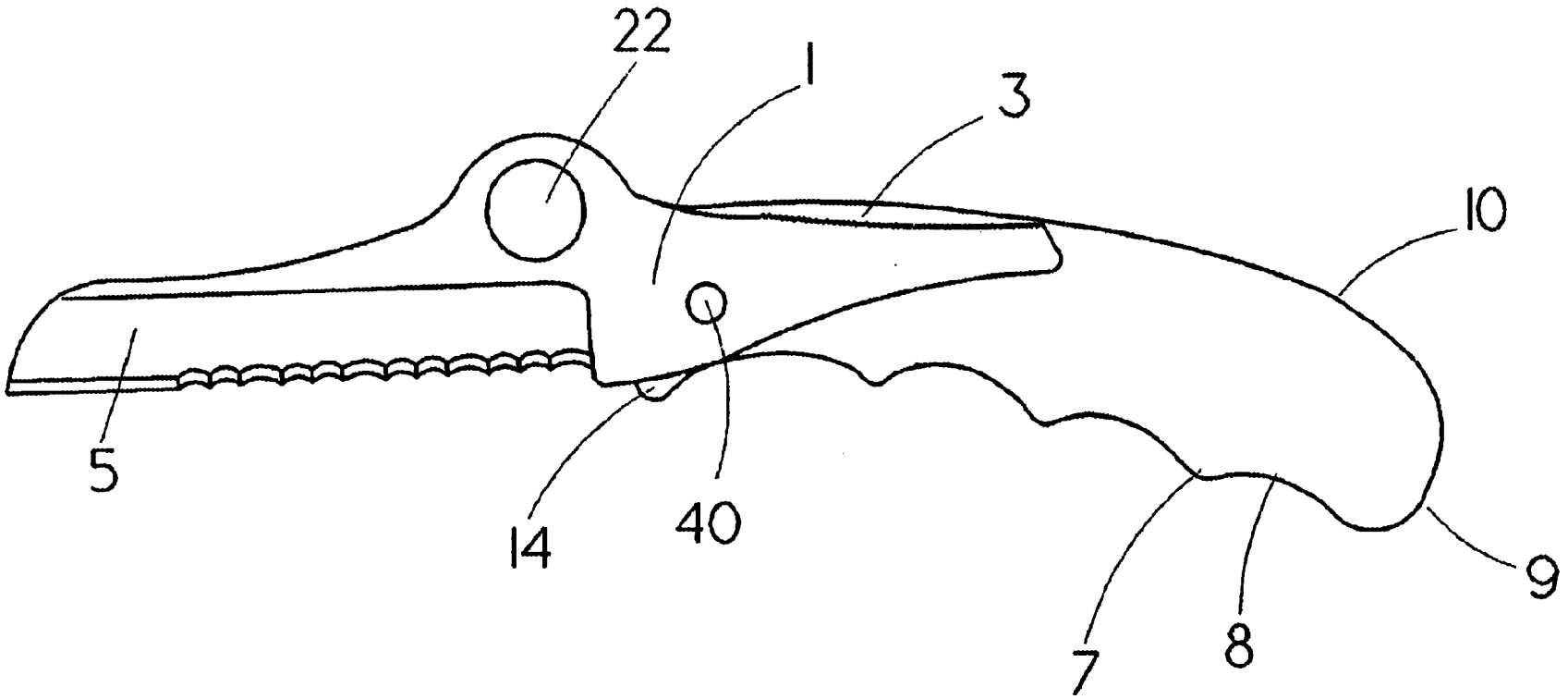
FIG. 12 is a front cut-away view of the knife of FIG. 11, with the knife blade in an extended position.
Figure 13:
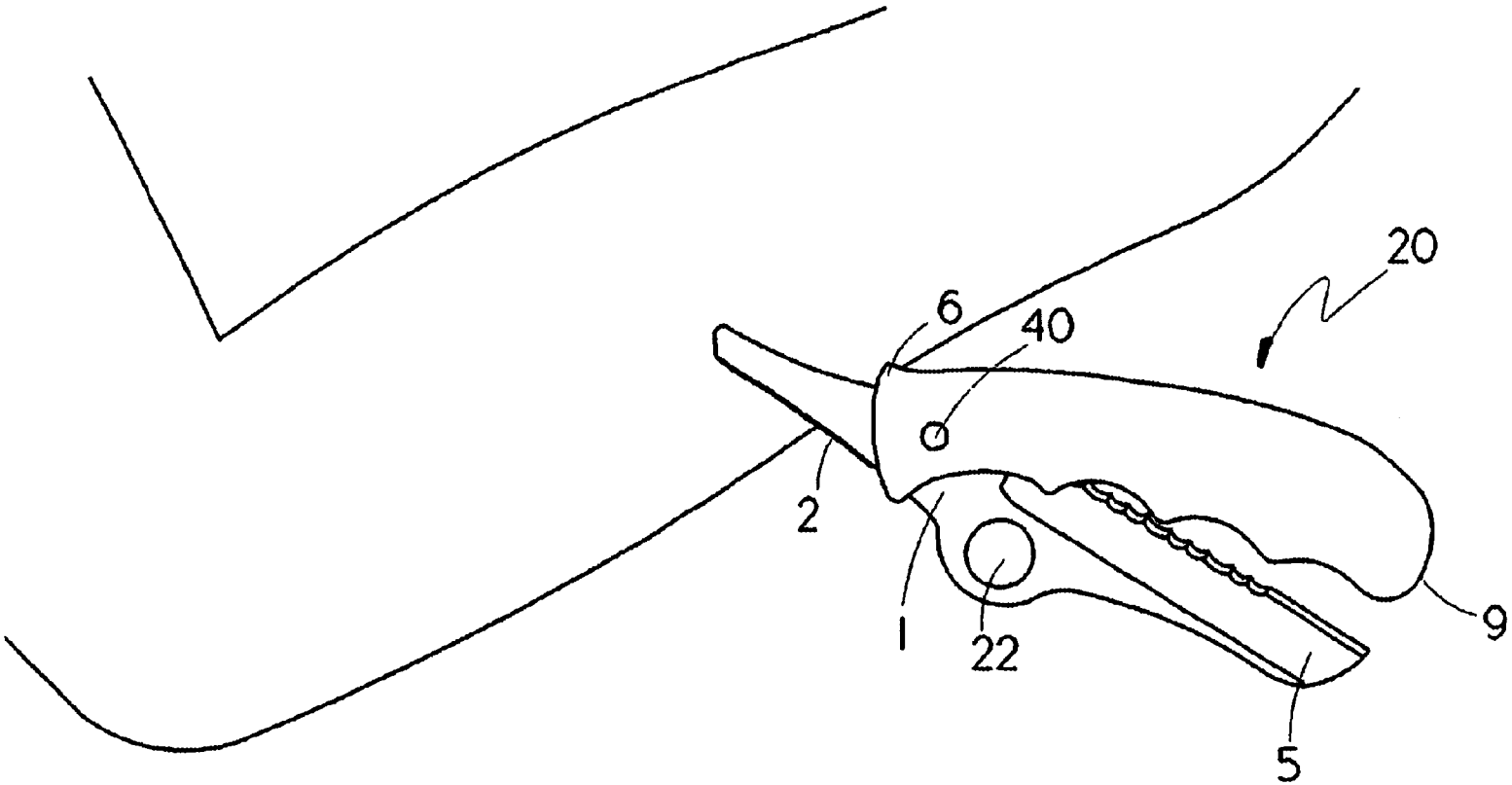
FIG. 13 is a perspective view of the knife of FIG. 11, with the knife blade shown beginning to open and the thumb extension ramp engaged against an opponent's appendage to initiate opening of the knife blade.
Figure 14:
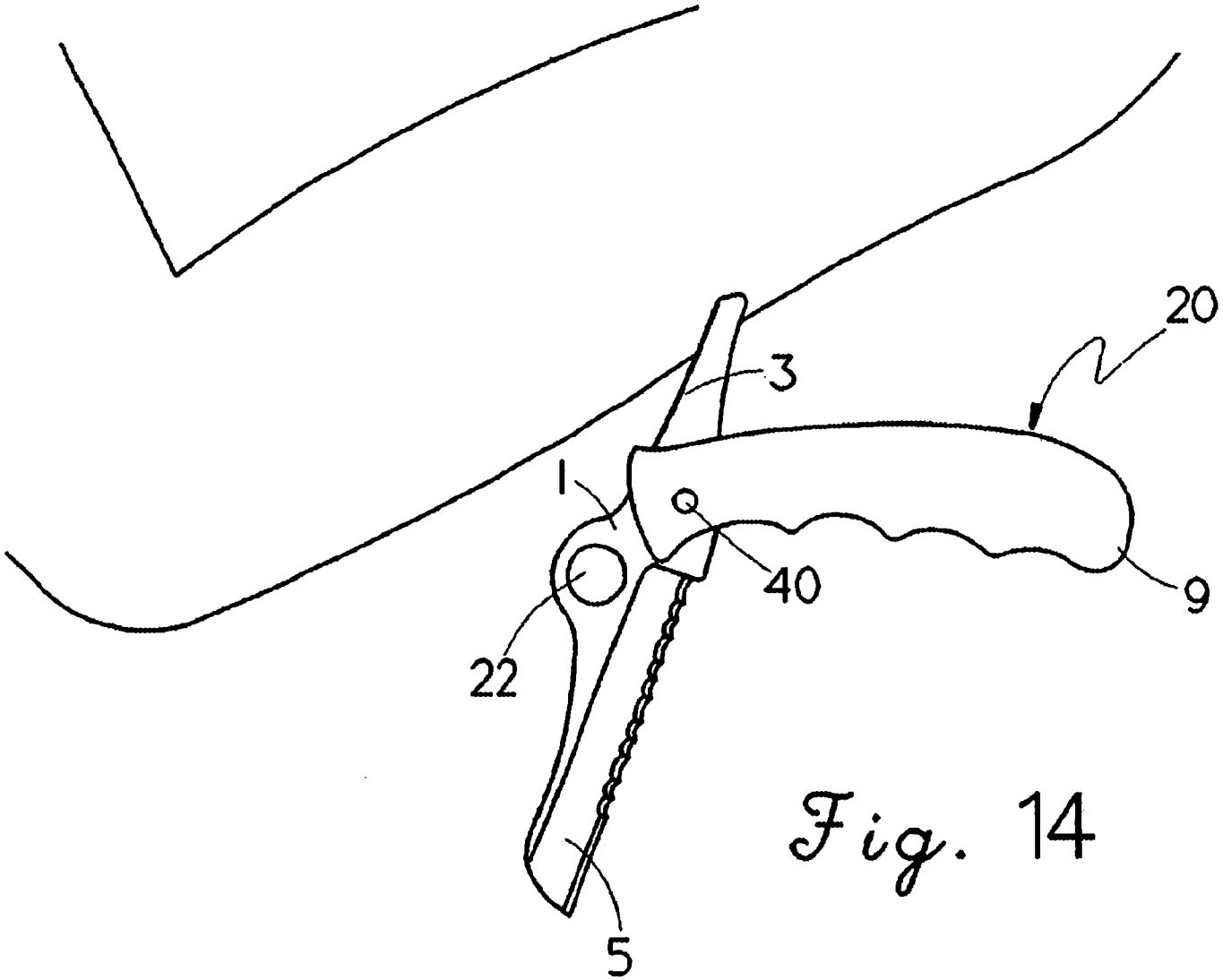
FIG. 14 is a front perspective view of the knife shown in FIG. 3 with the knife blade further opened.

Referring now to FIGS. 11–14, one of the alternate embodiments of the folding knife 20 of the present invention is shown dynamically moving from a closed position of use in FIG. 11 to an open position of use in FIG. 12. In FIG. 11, the curve of the thumb ramp 2 is not positioned close to the finger opening aperture 22, as it is in the other embodiments. Instead, the thumb ramp 1 possesses an elongated portion which extends from the heel end of the knife blade. The thumb ramp extends from the rear of the knife blade in such a way that the thumb ramp extends forward from the front of the knife handle when the knife blade is in a closed position with the cutting edge 5 positioned within the handle cavity 26. This embodiment provides an additional use of the knife against an attacker by having the thumb ramp exposed when the knife blade is in a closed position. The thumb ramp 1 of this alternate embodiment may still include the finger opening aperture 22. The thumb ramp additionally has a pivot point 40 which allows the thumb ramp to be connected to the handle and pivot with respect to the position of the handle. When the knife blade is extended, as shown in FIG. 12, the thumb ramp is aligned against the front of the handle. More specifically, FIG. 13 depicts the folding knife 20 in a position with the curve of the thumb ramp 2 positioned against an appendage of either the user or an opponent. As seen in FIG. 13, the user of the folding knife 20 is pulling the folding knife 20 in a direction toward the handle rear end 26, thus engaging the thumb ramp 2 against the opponents forearm in a manner perpendicular to the longitudinal axis of the knife blade. As shown in FIG. 14, as the knife handle continues to be drawn away and downward along the forearm, the curve of the thumb ramp 2 continues to engage the forearm, thus opening the knife blade from a closed position of use to an extended position of use. This dynamic motion creates a force which is the inevitable opening of the blade as shown in FIG. 13 and FIG. 14. The advantage of this particular type of opening mechanism is that the knife may be opened without the user putting any finger pressure whatsoever on the knife blade, and completely opening the knife by means of engaging the thumb ramp 2 on an object such as an opponent's arm, or other object. Thus, no spring mechanisms or other type of inherently dangerous opening devices are necessary to open this particular knife blade.

To assist the reader in understanding the various components of the present invention, the following numbering and associated list of components are provided herein;

1. Extended thumb ramp
2. Posterior curve of thumb ramp
3. Interior curve of thumb ramp
4. Blade secondary edge
5. Blade primary cutting edge
6. Handle horns
7. Handle flare
8. Handle finger retention point
9. Handle butt end
10. Handle posterior curve
11. Handle length
12. Clip
13. Handle dimple
14. Handle interior lower guard
15. Finger support notch
20. Folding knife
22. Finger opening aperture
24. Handle forward end
26. Handle cavity
30. Clip spoon
40. Pivot point
42. Blade locking mechanism The present invention has been described in an exemplary and preferred embodiment, but is not limited thereto. Those skilled in the art will recognize that a number of additional modifications and improvements can be made to the invention without the parts or from the essential spirit and scope. Therefore the invention is not limited by the above disclosure but only by the following claims.

What is claimed is:

1. A kinetic opening folding tool with a blade adapted for positionally opening on the body of an opponent or other object, comprising:

a handle having a front end, a rear end and a cavity positioned therebetween;

a clip interconnected to said handle for removable attachment to an article of clothing, said clip further comprising a finger depression confined within a perimeter edge of said clip, said finger depression adapted to facilitate rotation of said folding knife in a user's fingers;

a knife blade rotatably interconnected to said front end of said handle, said knife blade having a front end and a heel end which defines a longitudinal axis therebetween, a cutting edge, and an upper edge, said upper edge having a substantially triangular shaped protrusion extending therefrom, wherein when a lateral force is applied to said protrusion in a direction parallel to said longitudinal axis of said knife blade and in a direction toward said heel end of said knife blade, said knife blade opens to a first extended position of use, wherein said knife blade is substantially an extension of said handle, and wherein when said blade is in a second closed position of use said protrusion is substantially exposed from said handle; and a blade locking mechanism interconnected to said handle and in operable engagement with said heel end of said knife blade, wherein said knife blade is adapted to lock in said first extended position of use.

2. The folding knife of claim 1, wherein said substantially triangular shaped protrusion has a leading edge and a trailing edge originating from an apex of said substantially shaped triangular shaped protrusion, and each of said leading edge and said trailing edge extending substantially beyond said handle to allow engagement with the opponent or the object.

3. The folding knife of claim 1, wherein said substantially triangular shaped protrusion hump has a thumb ramp wit serrations to frictionally engage a user's thumb.

4. The folding knife of claim 1, wherein an upper edge of said front end of said handle is pointed.

5. The folding knife of claim 1, wherein said rear end of said handle is pointed to provide a point of impact for shattering glass.

6. The folding knife of claim 1, wherein said blade locking mechanism has a release mechanism positioned along said upper edge of said handle of said knife for engagement with a user's fingers.

7. The folding knife of claim 1, wherein said substantially substantially triangular shaped protrusion extends upwardly from said upper edge of said knife blade at least about 1.27 centimeters or 0.5 inches.

8. The folding knife of claim 1, further comprising an aperture positioned within said substantially triangular shaped protrusion of said folding knife, said aperture adapted for engaging a user's thumb to assist in the opening of said knife blade.

9. The folding knife of claim 1, wherein at least a portion of said upper edge of said blade is sharpened.

10. The folding knife of claim 1, further comprising a horn with a pointed tip extending upwardly from said upper edge of said handle proximate to said first end which is adapted for providing a pinch point.

11. The folding knife of claim 1 further comprising a plurality of pointed flares extending downwardly from said lower edge of said handle for engaging a user's fingers during use.

12. The folding knife of claim 1, wherein said handle further comprises a recessed dimple positioned on an exterior surface of said handle and positioned substantially opposite from said finger depression in said clip, wherein said dimple is adapted to engage a user's fingers to facilitate proper positioning of said folding knife.

13. A folding knife having a blade which is adapted to open kinetically upon contact with an object or a body part of an opponent, said folding knife comprising:

a handle having a first end, a second end, an upper edge and a lower edge and a cavity positioned between said first end and said second end;

a clip interconnected to said handle, said clip further comprising a finger depression confined within and positioned below a perimeter edge of said clip, said finger depression adapted to receive at least one of a user's fingers and a thumb;

a blade having a pointed front end, a heel end, a lower edge and an upper edge, said heel end rotatably interconnected to said handle first end; and a thumb extension extending from said upper edge of said blade, and shaped to engage the object or the body part of an opponent, wherein when said thumb extension comes in lateral contact with the object or the body part of an opponent said blade is opened between a second closed position with said knife blade positioned within said handle cavity and a first extended position wherein said knife blade is a longitudinal extension of said knife handle, and wherein when said blade is in said second closed position said thumb extension is substantially entirely exposed from said handle.

14. The folding knife of claim 13, wherein said thumb extension has an aperture extending therethrough for engagement with a user's thumb, wherein said blade is adapted to open from said second closed position to said first positions with one hand.

15. The folding knife of claim 14, wherein said aperture has a substantially round shape which is adapted to receive a user's thumb.

16. The folding knife of claim 13, wherein said thumb extension has a plurality of serrations positioned along an outer edge for frictionally engaging an object.

17. The folding knife of claim 13, wherein said thumb extension extends from said upper edge of said knife handle at least about 0.5 inches.

18. The folding knife of claim 13, wherein said handle second end has a point.

19. The folding knife of claim 13, further comprising a handle horn extending outwardly from said upper edge of said handle proximate to said thumb extension, said handle horn adapted to provide a pinch point when said blade is in a closed position of use.

20. The folding knife of claim 13, further comprising one or more handle flares extending outwardly from said handle lower edge for enhancing user's hand grip on said folding knife handle during use.

21. The folding knife of claim 13, wherein said handle second end is at least partially comprised of a metallic material.

22. The folding knife of claim 13, wherein said lower edge of said blade is sharpened.

23. The folding knife of claim 13, wherein said handle further comprises a recessed dimple positioned on an exterior surface of said handle and positioned substantially opposite from said finger depression in said clip, wherein said dimple is adapted to engage a user's fingers to facilitate proper positioning of said folding knife.

* * * * *